US005306192A

United States Patent [19]

Caveza et al.

[11] Patent Number: 5,306,192

[45] Date of Patent: Apr. 26, 1994

[54] SIMULATED TOY HAMBURGER MAKER

[75] Inventors: Martin J. Caveza, Redondo Beach; Caleb S. Chung, Van Nuys; John N. Handy, Long Beach; Jim I. Tucker, Manhattan Beach, all of Calif.

[73] Assignee: Mattel, Inc., El Segundo, Calif.

[21] Appl. No.: 12,716

[22] Filed: Feb. 3, 1993

[51] Int. Cl.[5] ..... A63H 33/30

[52] U.S. Cl. ..... 446/71; 446/481; 446/475; 426/104

[58] Field of Search ..... 446/479, 481, 397, 475, 446/246, 491, 71; 434/219, 127; 426/104, 250

[56] References Cited

U.S. PATENT DOCUMENTS

| | | | |
|---|---|---|---|
| 3,808,730 | 5/1974 | Cooper et al. | 446/481 |
| 4,202,260 | 5/1980 | Weger | 99/450.4 |
| 4,383,386 | 5/1983 | Giordano et al. | 446/481 X |
| 4,944,218 | 7/1990 | Cresson | 99/357 |
| 5,113,753 | 5/1992 | Robinson | 99/326 |

*Primary Examiner*—Mickey Yu

*Attorney, Agent, or Firm*—Roy A. Ekstrand

[57] ABSTRACT

A simulated toy hamburger maker includes a mixer grinder, a simulated cooking station, a condiment dispenser apparatus and a hamburger bun storage and dispenser. A mixture of edible food materials such as ground cereal and peanut butter together with edible colorant materials such as chocolate powder is combined and mixed within the grinder mixer station to form a simulated hamburger mixture. The simulated cooking station includes a hamburger press which conforms a quantity of the hamburger mixture into a realistic hamburger patty. The simulated hamburger patty is then placed upon simulated hamburger buns such as conventional vanilla wafer cookies or the like and positioned within a condiment dispensing station. Condiment dispensers are provided which receive a quantity of colored edible material such as cake frosting or the like to extrude upon the simulated hamburger patties. A second cookie simulating the upper bun portion of a hamburger sandwich is then placed upon the condiment bearing patty to complete the simulated hamburger.

14 Claims, 2 Drawing Sheets

FIG. 2
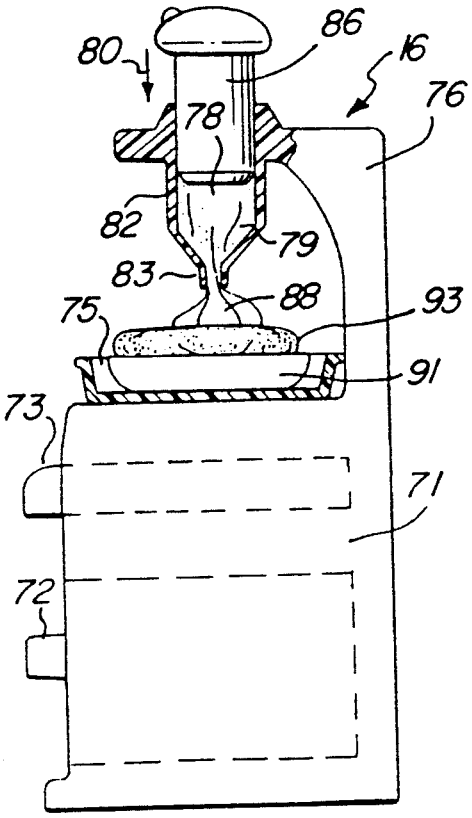
FIG. 3
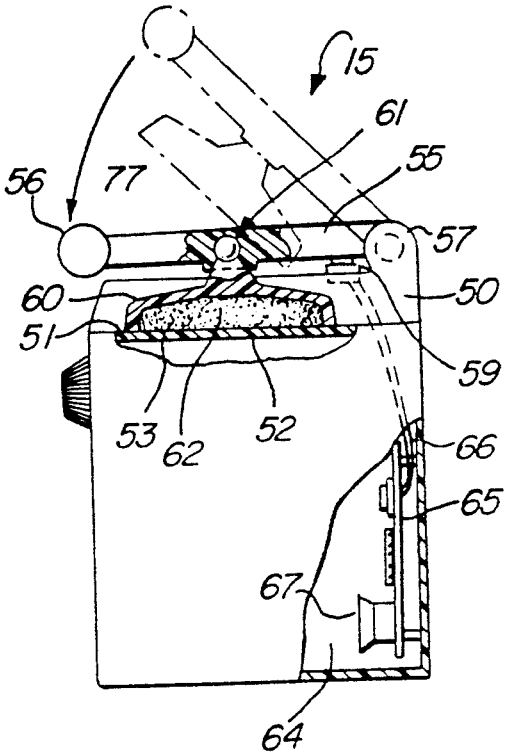
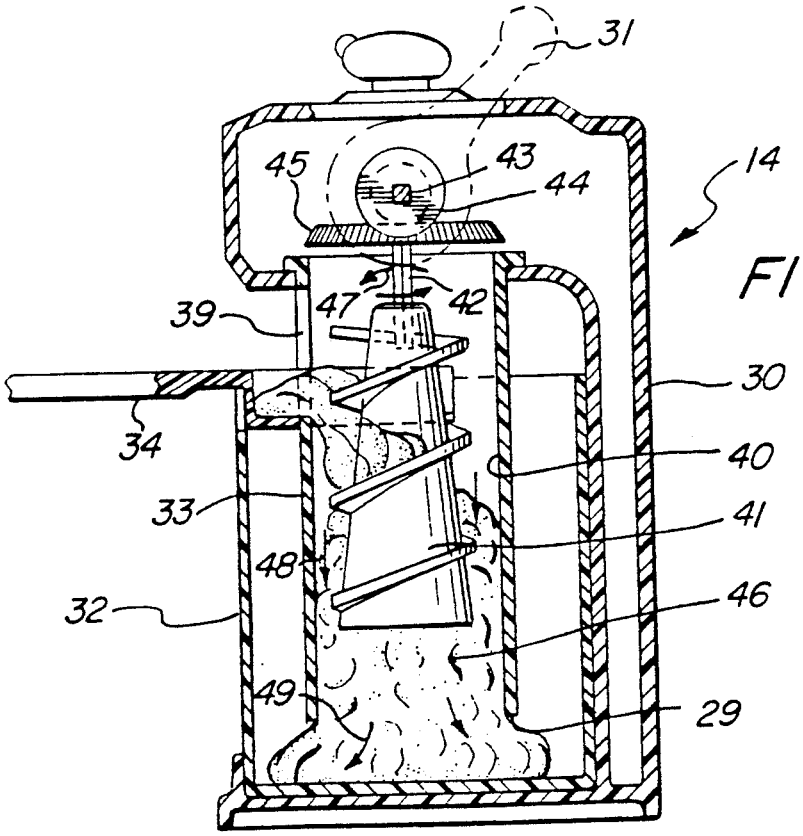
FIG. 4

SIMULATED TOY HAMBURGER MAKER

FIELD OF THE INVENTION

This invention relates generally to toy food preparation products and particularly to those simulating food cooking.

BACKGROUND OF THE INVENTION

One of the basic principles which guide toy makers in their neverending quest for newer and more popular toys for young children is the realization that children enjoy mimicking or imitating the various actions of life which they see adults participating in as they go through their day. In accordance with this basic principle, practitioners in the art have found that children viewing food preparation and cooking activities by adults have a desire to imitate and mimic these activities themselves. In view of this popularity and need, practitioners in the art have endeavored to provide toy food cooking and preparation products. Several limitations exist, however, in the creation and provision of such toy products. For example, great care must be exercised in the structures utilizing heating or cooking elements to avoid the danger of burn injury to young children. In addition, the simulated food products themselves must be subjected to exhaustive safety inspection and consideration dealing with problems such as toxicity and the ever present danger of children ingesting simulated food products. Notwithstanding these limitations and difficulties, the pressure created by the extreme popularity of this market segment has continued to motivate practitioners in the toy arts to provide evermore realistic and exciting food preparation type toys.

For example, U.S. Pat. No. 4,383,386 issued to Giordano, et al. sets forth a TOY SKILLET AND KNIFE HAVING SIMULATED SOUND PRODUCING CAPABILITIES in which a miniature frying skillet defines a simulated cooking surface have dielectric material areas formed thereon and an outwardly extending handle. A sound producing circuit within the handle responds to the presence of material within the skillet upon the cooking surface to produce a realistic frying sound thereby simulating the cooking of the material. Additional sound producing apparatus provides further sound enhancement such as the sound of a slicing knife or the like.

U.S. Pat. No. 3,808,730 issued to Cooper, et al. sets forth a TOY OVEN having an interior simulated baking cavity within a toy oven housing. A tray within the baking cavity is operatively coupled to the oven door to be raised upwardly as the oven door is closed. A mold is suspended upon the upper surface of the baking cavity and defines a lower surface forming a mold member which replicates the upper surface of a baked food article. A dish having deformable simulated food material is positioned within the baking cavity upon the tray and raised by the operative mechanism as the toy is closed to be forced against the mold and have embossed thereon a simulated baking appearance.

U.S. Pat. No. 5,113,753 issued to Robinson sets forth an APPARATUS FOR AUTOMATIC APPLICATION OF CONDIMENTS TO A SANDWICH having a computer control and a plurality of condiment material dispensers coupled to a computer controlled pump. A flexible spreader blade rotates over the condiment depositing area and is operated after each condiment deposit upon an underlying sandwich to smooth out the condiment material.

U.S. Pat. No. 4,944,218 issued to Cresson sets forth a VENDING MACHINE FOR PREPARING AND DELIVERING HAMBURGERS which provides automatic operation for preparing and delivering hamburgers to a consumer utilizing a payment system. The vending machine includes an oven for cooking the meat portion, a first station for delivering rolls or bread to a conveyor and one or more successive condiment application stations followed by a wrapping or covering station.

U.S. Pat. NO. 4,202,260 issued to Weger sets forth an AUTOMATIC SANDWICH MAKING APPARATUS consisting of an upper and lower support for receiving and supporting a slice of bread. A sandwich station is formed on the lower support and apparatus is movable to lower the bread dispensing station. A selection panel controls the deposit of various condiments upon the sandwich bread as it is moved through the sandwich making stations.

While the foregoing described prior art devices have provided some measure of success, there remains nonetheless a continuing need in the art for evermore improved toys which simulate the cooking process and which entertain and amuse young children.

Accordingly, it is a general object of the present invention to provide an improved food preparation simulation toy. It is a more particular object of the present invention to provide an improved simulated toy hamburger maker which avoids exposing the child user to the risk of burn injury while producing an edible food product which the child may consume.

In accordance with the present invention, there is provided a simulated toy hamburger maker for use in combination with a malleable food mixture and a plurality of generally disk-shaped food articles, the simulated toy hamburger maker comprises: mixing means for receiving the constituents of the malleable food mixture and for forming a generally uniform mixture thereof; simulated cooking means for receiving a quantity of the generally uniform mixture and for forming a disk-like patty thereof; and condiment means for receiving an edible extrudible food material and for depositing a quantity thereof upon one of the disk-like patties, the disk-like patty and the deposited extrudible food material being combined with a pair of the disk-shaped food articles to form a simulated hamburger.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 2 sets forth a section view of the present invention simulated toy hamburger maker taken along section lines 2—2 in FIG. 1;

FIG. 3 sets forth a section view of the hamburger cooking portion of the present invention simulated toy hamburger maker taken in along section lines 3—3 in FIG. 1; and FIG. 4 sets forth a section view of the present invention simulated toy hamburger maker taken along section lines 4—4 in FIG. 1.

DESCRIPTION OF THE PREFERRED EMBODIMENT

Figure 1:
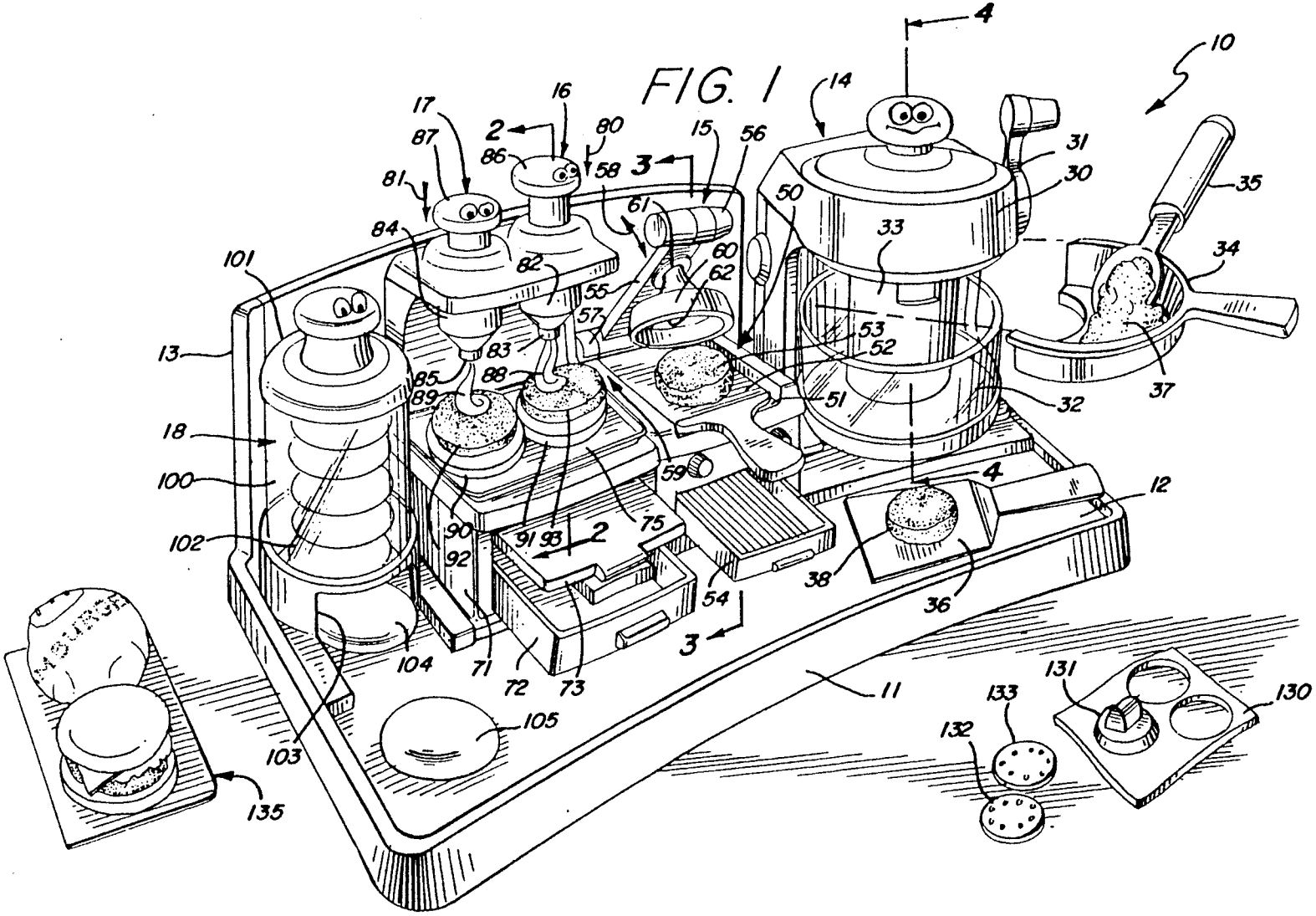
FIG. 1 sets forth a front perspective view of a simulated toy hamburger maker constructed in accordance with the present invention.

FIG. 1 sets forth a front perspective view of a simulated toy hamburger maker constructed in accordance with the present invention and generally referenced by numeral 10. Hamburger maker 10 includes a generally planar support base 11 defining an upper surface 12 and a vertical backing portion 13. Hamburger maker 10 includes a grinder and mixer station 14, a burger cooking station 15, a pair of condiment dispensers 16 and 17 and a hamburger bun dispenser 18 all supported upon surface 12 of base 11. The object of toy hamburger maker 10 is to provide a complete hamburger preparation and cooking and assembly system which mimics the fast food processing operations which children see in the various popular fast food or burger restaurants and drive-thrus. In accordance with an important aspect of the present invention, toy hamburger maker 10 avoids the use of any heating element or other potentially injurious devices leaving the child user free to prepare a variety of hamburgers using ingredients which are typically found in most home kitchens and producing a resulting "hamburger" which may be freely and enjoyably consumed. Accordingly, toy hamburger maker 10 processes a simulated hamburger material which in its preferred form is fabricated from readily available materials such as rice krispy cereal, peanut butter, chocolate powder or cocoa and a suitable binder such as milk or water. In addition, the "hamburger buns" utilized in preparing the simulated hamburger are preferably formed of pairs of conventional cookies such as vanilla wafers or the like chosen for their general resemblance to a half of a hamburger bun and thus when used in pairs closely replicate a conventional hamburger bun. Continuing in this theme, the present invention hamburger set utilizes compatible food materials to simulate condiments such as mustard and ketchup by employing appropriately colored frosting mixes such as vanilla frosting colored with conventional edible food dyes of red and yellow or the like. Finally, additional hamburger ingredients such as simulated food articles corresponding to tomatoes or cheese slices or pickle slices are fabricating using the popular fruit rolls which are available in various colors and flavors and which form thin relatively elastic sheets of fruit flavored gellike material. A variety of cutters similar to cookie cutters may then be used to produce simulated tomatoes using red fruit sheets, cheese slices using yellow fruit sheets, and pickles using green fruit sheets. All of this combines to provide an entertainable and enjoyable simulated hamburger maker which produces a completed burger that the child user and other coparticipants may readily enjoy and consume.

More specifically, grinder mixer station 14 is set forth below in FIG. 4 in greater detail. However, suffice it to note here that grinder mixer station 14 includes a housing 30 supporting a crank handle 31, a grinder cylinder 33 and a mixing bowl 32. By means set forth below in greater detail, a simulated hamburger 37 is formed by placing the selected group of ingredients such as the combination of a cereal material such as rice krispies, peanut butter, chocolate powder and a small quantity of water and other suitable binder within grinder mixer station 14 as crank handle 31 is turned by the child user. By means also set forth below in greater detail, the ingredients are mixed and ground within grinder cylinder 33 to form a hamburger mixture 37 which may be conveniently handled by a hamburger scoop 34 and a mixing spoon 35. A small quantity of the completed hamburger mix is then placed upon a spatula 36 and formed to approximate a patty 38. In most instances, a quantity of hamburger of hamburger mix 37 may be placed upon spatula 36 without great care as to forming patty 38 due to the simulated cooking process which follows and which more precisely forms the hamburger mix into a simulated hamburger patty.

Cooking station 15 includes a simulated grill unit 50 having an upwardly facing cooking surface 51 which receives a spatula 52 in a simple slide attachment. Grill unit 50 further includes an arm 55 having a handle 56 at the outer end thereof and being pivotally secured to grill unit 50 at a rear hinge 57. Thus, handle 56 and arm 55 are pivotally movable in the manner shown by arrows 58. Grill unit 50 further includes a generally circular hamburger press 60 coupled to the underside of arm 55 by a ball joint attachment 61. Hamburger press 60 further defines an interior cavity 62 defining a mold cavity which corresponds to the desired shape and configuration of the simulated hamburger patties being utilized in the present invention system. Grill unit 50 further includes a drawer 54 for the convenient storage of "cooked" hamburger patties or the like. Grill unit 50 further includes a switch 59 which in accordance with the operation set forth below in FIG. 3 responds to the closed position of arm 55 to activate a sound producing mechanism within grill unit 50 to simulate the sound of frying hamburgers to add further realism to the present invention.

Thus, in operation, a quantity of hamburger mix 37 is deposited upon spatula 52. Thereafter, the child user grips handle 56 and pivots arm 55 and press 60 upwardly to expose cooking surface 51. Spatula 52 is then placed upon cooking surface 51 such that the quantity of hamburger mix is generally positioned beneath press 60. Next, the child user moves handle 56 and arm 55 downwardly to lower press 60 upon spatula 52 such that the quantity of hamburger mix is received within interior cavity 62 of press 60. During this operation, ball joint 61 facilitates the proper positioning and alignment of press 60 as the angular position of arm 55 changes during the downward stroke. Once press 60 has been positioned to generally enclose the quantity of hamburger mix and captivate it within cavity 62, the child user then forces handle 56 downwardly an additional amount to form patty 63 upon spatula 52. The downward motion of arm 55 actuates switch 59 in the manner shown in FIG. 3 to energize a sound producing system (also seen in FIG. 3) which by conventional sound producing means generates a sound simulating the frying of hamburger meat or the like.

Once the hamburger patty is "cooked", handle 56 and arm 55 are pivoted upwardly raising press 60 from spatula 52 and leaving a formed patty 53 upon spatula 52 which conforms in appearance and shape to a cooked hamburger.

Bun dispenser 18 includes a cylindrical housing 100 within which a plurality of simulated hamburger buns are stacked for convenience. As mentioned above, a number of different edible food products such as cookies or the like may be utilized to simulate the hamburger buns in the present invention food preparation toy. However, it has been found particularly advantageous to utilize a dome-shaped cookie such as a vanilla wafer or the like to provide buns 102. Lid 101 of bun dispenser 18 is removable and permits the refilling of cylindrical housing 100. Housing 100 further defines an opening 103 through which the bottommost one of buns 102 is withdrawn by the child user.

Continuing the hamburger preparation operation, once a hamburger patty has been "cooked" at cooking station 15, a pair of simulated hamburger buns 104 and 105 are withdrawn from bun dispenser 18 to complete the assembly of a simulated hamburger.

Toy hamburger station 10 further includes a pair of condiment dispensers 16 and 17 supported by a common housing 71 and a support stand 76. Housing 71 includes a removable drawer 72 and a slide out simulated cutting board 73. A tray 75 is supported upon housing 71 and receives a pair of hamburger bun portions 90 and 91. Similarly, a pair of simulated hamburger patties 92 and 93 are placed upon bun portions 90 and 91 to facilitate the addition of facilitated condiments within condiment dispensers 16 and 17. In their preferred form, condiment dispensers 16 and 17 include generally cylindrical extruder tubes 82 and 84 respectively which in turn define downwardly extending extruder nozzles 83 and 85 respectively. Condiment dispensers 16 and 17 further include movable plungers 86 and 87 respectively.

The structure and operation of condiment dispensers 16 and 17 is set forth and described below in FIG. 2 in greater detail. However, suffice it to note here that extruder tubes 82 and 84 are filled with a simulated condiment material such as colored frosting or the like by removing plungers 86 and 87. Thereafter, plungers 86 and 87 are reinserted into extruder tubes 82 and 84. With a pair of simulated hamburger buns 90 and 91 supporting patties 92 and 93 respectively in position upon tray 75, the user simply presses condiment dispenser plungers 86 and 87 downwardly in the direction indicated by arrows 80 and 81 respectively to produce deposits of simulated condiment material 88 and 89 upon patties 93 and 92. By way of example, condiment dispenser 16 may receive and support a quantity of yellow colored frosting to simulate mustard while condiment dispenser 17 may receive and support a quantity of red colored frosting to simulate ketchup. Tray 75 may then be reversed to reverse the position of the food patties beneath condiment dispensers 16 and 17 for further condiment processing.

To add further realism to the present invention simulated toy hamburger maker, a quantity of sheet food 130 suitable colored and formed of a somewhat elastic food substance such as fruit rolls or a concentrated mixture of dessert gelatin is then shaped by an appropriate cutter 131. In the example shown, sheet food 130 is selected and colored to correspond to the red orange color of tomato slices and correspondingly cutter 131 is circular in shape and provides circular cut segments 132 and 133 having a sliced tomato appearance. Simulated sliced tomatoes 132 and 133 may then be placed upon the condiment treated patties supported by tray 75 afterwhich additional bun portions 104 and 105 are placed upon the simulated tomatoes to produce a completed burger such as completed burger 135 which is now ready for serving.

As mentioned above, completed burger 135 is fabricated entirely of edible food products and thus may be consumed by the child user and other coparticipants of the child user. In its preferred form, hamburger 135 is fabricated using taste compatible constituents to increase the enjoyment of burger consumption. In its preferred form, toy hamburger maker 10 is fabricated of molded plastic material which may be easily disassembled and washed in accordance with conventional fabrication techniques to provide easy clean-up.

FIG. 2 sets forth a section view of condiment dispenser 16 taken along section lines 2—2 in FIG. 1. At the outset, it should be understood that condiment dispensers 16 and 17 are identical and thus the descriptions and illustrations of FIG. 2 relating to condiment dispenser 16 are equally applicable to condiment dispenser 17. Thus, condiment dispenser 16 includes a housing 71 supporting a simulated cutting board 73 and a drawer 72. Housing 71 further includes a vertical support 76 having a generally cylindrical extruder tube 82 supported thereby. Extruder tube 82 defines a cylindrical bore 79 and a downwardly extending nozzle 83. A plunger 86 is slidably received within bore 79. A tray 75 is received upon the upper surface of housing 71 beneath extruder 82 and supports a bun 91 and a patty 93 provided in the manner set forth above. A quantity of simulated condiment material 78 such as yellow colored frosting or the like is deposited within bore 79 of condiment dispenser 16. Thereafter, plunger 86 is received within bore 79 and simulated condiment 78 is dispensed by pressing plunger 86 downwardly in the direction indicated by arrow 80 to force a deposited quantity of simulated condiment 88 outwardly from nozzle 83 to the upper surface of patty 93. Thus, condiment dispenser 16 provides a realistic simulation of the application of a condiment to a hamburger patty within the environment of a fast food restaurant.

FIG. 3 sets forth a partial section view of grill unit 50 within cooking station 15. Cooking station 15 includes a grill unit 50 defining a cooking surface 51 which receives a spatula 52 in the manner set forth above in FIG. 1. Grill unit 50 further includes a pivotally supported arm 55 having a handle 56 which is coupled to a hinge 57 at the rear portion of grill unit 50. Grill unit 50 further defines an interior cavity 64 within which a conventional sound producing circuit 65 is supported. A switch 59 is supported by grill unit 50 and is actuated as arm 55 is moved to the horizontal position shown in FIG. 3. A plurality of wires 66 couples switch 59 to sound circuit 65. Sound circuit 65 further includes an electroacoustic transducer 67 for producing audible sound output in response to the electrical signals formed within circuit 65. Cooking station 15 further includes a hamburger press 60 defining an interior cavity 62 supported upon and coupled to arm 55 by a conventional ball joint attachment 61. A simulated hamburger patty 53 is shown supported upon spatula 52 within interior cavity 62.

In the manner described above, spatula 52 bearing a quantity of to-be-formed hamburger patty material is received beneath hamburger press 60 while handle 56 and arm 55 are raised to the position shown in dashed-line representation in FIG. 3. Thereafter, the user moves handle 56 downwardly in the arc described by arrow 77 to position press 60 in an overlying relationship to spatula 52 and captivate the quantity of simulated hamburger material within cavity 62. The downward force applied to handle 56 presses the material within cavity 62 into a form corresponding to hamburger patty 53. Concurrently, switch 59 is actuated as arm 55 is moved downwardly to its horizontal position. In response to closure of switch 59, sound circuit 65 is activated to produce electrical signals corresponding to the sound of frying food. It will be recognized by those skilled in the art that sound circuit 65 may be constructed entirely in accordance with known fabricated techniques and the design thereof is a matter of design choice. For example, the sound circuit may be fabricated in the manner corresponding to the circuit set forth in the above-mentioned prior art patent U.S. Pat. No. 4,383,386 issued to Giordano, et al. and set forth above in the background of the invention.

Thus, during the closure of arm 55 shown in solid line representation, patty 53 is formed to resemble a cooked hamburger and a sound simulating the frying of food is produced by sound circuit 65. Once the desired "cooking" has taken place, the user then raises handle 56 pivoting arm 55 upwardly and raising hamburger press 60 to reveal a formed hamburger patty 53. Concurrently, the upward motion of arm 55 opens switch 59 and terminates the production of cooking sound.

FIG. 4 sets forth a section view of grinder and mixer station 14 taken along section lines 4—4 in FIG. 1. As described above, grinder and mixer 14 includes a housing 30 supporting rotatable crank handle 31. A shaft 43 extends through the upper portion of housing 30 and supports handle 31 and a bevel gear 44. Shaft 43 is rotatably supported and coupled to handle 31 in accordance with conventional fabrication techniques (not shown). A horizontally disposed bevel gear 45 is supported within housing 31 by conventional support means (not shown) and is coupled to a downwardly extending shaft 42. Shaft 42 is coupled to a downwardly extending auger 41. A grinder cylinder 33 is supported by housing 30 and encloses auger 41 to form a mixing grinding chamber. Grinder cylinder 33 defines a frontal aperture 39 and a bottom opening 29. Grinder and mixer 14 further includes a mixing bowl 32 which receives grinder cylinder 33 and generally encircles at least a portion of cylinder 33. A hamburger scoop 34 is configured to be received upon cylinder 33 within mixing bowl 32 in alignment with aperture 39.

In accordance with the present invention, the above-described ingredients utilized to form the hamburger patty material of the present invention are deposited within grinder cylinder 33 utilizing hamburger scoop 34 and aperture 39. Thereafter, handle 31 is turned by the user rotating shaft 43 and bevel gears 44 and 45 to produce rotation of shaft 42 in the direction indicated by arrow 47. The rotation of shaft 42 in turn rotates auger 41 correspondingly drawing the to-be-mixed ingredients into grinder cylinder 33 and mixing them while causing a general downward flow of mixing material in the direction indicated by arrow 48. Thereafter, the resulting mixture 46 is passed outwardly through bottom opening 29 of cylinder 33 to be received within mixing bowl 32. Mixture 46 may then be utilized to form the above-described hamburger patties and carry forward the present invention simulated hamburger making.

What has been shown is a novel and safe simulated hamburger maker which may be easily operated by younger children and which provides a series of interesting and amusing play patterns by which the child user is able to fabricate simulated hamburger sandwiches. The operation and sequence of activities may be varied somewhat in accordance with the child user's preferences while nonetheless maintaining an interesting and relatively authentic overall process replicating a fast food hamburger operation. It will be apparent to those skilled in the art that a variety of materials and simulated fast food type sandwiches may be processed in accordance with the present invention without departing from the spirit and scope thereof.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A simulated toy hamburger maker for use in combination with a malleable food mixture and a plurality of generally diskshaped food articles, said simulated toy hamburger maker comprising:

mixing means for receiving the constituents of said malleable food mixture and for forming a generally uniform mixture thereof;

noncoating simulated cooking means for receiving a quantity of said generally uniform mixture and for forming a disk-like patty thereof; and condiment dispensing means for receiving an edible extrudible food material and for depositing a quantity thereof upon one of said disk-like patties, said disk-like patty and said deposited extrudible food material being combined with a pair of said disk-shaped food articles to form a simulated hamburger.

2. A simulated toy hamburger maker as set forth in claim 1 further including a bun dispenser for receiving and storing a plurality of said generally disk-shaped food articles.

3. A simulated toy hamburger maker as set forth in claim 2 wherein said simulated cooking means includes a press defining an interior mold cavity.

4. A simulated toy hamburger maker as set forth in claim 3 wherein said simulated cooking means includes:

an arm supporting said press;

a simulated cooking surface for receiving and supporting said quantity of said generally uniform mixture beneath said press; and an arm support for supporting said arm in a movable attachment in which said press is movable between a first position upon said simulated cooking surface to force said press upon said quantity of said generally uniform mixture and a second position away from said simulated cooking surface.

5. A simulated toy hamburger maker as set forth in claim 4 wherein said arm support includes a hinge.

6. A simulated toy hamburger maker as set forth in claim 5 further including a cutter shaped to correspond to form circular cut-outs of a sheet of elastic food material.

7. A simulated toy hamburger maker as set forth in claim 2 wherein said disk-shaped food articles are cookies and wherein said bun dispenser includes a housing for receiving a plurality of said cookies in a vertically stacked array.

8. A simulated toy hamburger maker as set forth in claim 7 wherein said extrudible food material includes cake frosting and a food coloring agent and wherein said condiment dispensing means includes at least two dispensers.

9. A simulated toy hamburger maker as set forth in claim 8 wherein each of said dispensers of said condiment dispensing means includes an extruder having an output nozzle, an interior bore and a plunger movable therein.

10. A simulated toy hamburger maker as set forth in claim 3 wherein said simulated cooking means includes sound means for producing a sound similar to the sound of food frying.

11. For use in making a sandwich having an appearance suggestive of a burger from a malleable food mixture, a pair of disk-shaped food articles and an extrudible food material, a simulated toy burger maker comprising:

a mixer for receiving said malleable food mixture;

a noncoating simulated grill for receiving a quantity of said malleable food mixture and forming a simulated burger patty therefrom; and condiment dispensing means for receiving and dispensing said extrudible food material upon said simulated burger patty, said simulated burger patty and said extrudible food material being placed between a pair of said disk-shaped food articles to form an edible sandwich having an appearance suggestive of a burger.

12. A simulated toy burger maker as set forth in claim 11 wherein said disk-shaped food articles are cookies and wherein said simulated toy burger maker further includes a housing for receiving a plurality of said cookies.

13. A simulated toy burger maker as set forth in claim 12 wherein said extrudible food material includes a frosting and a food coloring agent and wherein said condiment means includes at least a pair of hand operated extruders each receiving a differently colored frosting.

14. Toy means for making an edible sandwich having an appearance suggestive of a burger, said toy means comprising:

a plurality of food constituents edible without further cooking;

means for combining said plurality of food constituents to form a malleable food mixture;

means for forming a patty of said malleable food mixture;

means for simulating cooking of said patty;

a pair of generally disk-shaped cookies;

means for supporting said patty upon one of said cookies; and means for depositing a colored frosting upon said patty;

the other of said cookies being placed upon said deposited colored frosting and said patty to provide an appearance similar to a hamburger.

* * * * *